US007191600B2

(12) United States Patent
Gao et al.

(10) Patent No.: US 7,191,600 B2
(45) Date of Patent: Mar. 20, 2007

(54) FAST WARM UP PULSE TUBE

(75) Inventors: Jin Lin Gao, Allentown, PA (US); Ralph C. Longsworth, Allentown, PA (US)

(73) Assignees: SHI-APD Cryogenics, Inc., Allentown, PA (US); Sumitomo Heavy Industries, Tokyo (JP)

( * ) Notice: Subject to any disclaimer, the term of this patent is extended or adjusted under 35 U.S.C. 154(b) by 403 days.

(21) Appl. No.: 10/500,982

(22) PCT Filed: Mar. 5, 2003

(86) PCT No.: PCT/US03/06580

§ 371 (c)(1),
(2), (4) Date: Jul. 2, 2004

(87) PCT Pub. No.: WO03/076854

PCT Pub. Date: Sep. 18, 2003

(65) Prior Publication Data

US 2005/0115247 A1 Jun. 2, 2005

Related U.S. Application Data

(60) Provisional application No. 60/361,651, filed on Mar. 5, 2002.

(51) Int. Cl.
*F25B 9/00* (2006.01)

(52) U.S. Cl. ..... 62/6

(58) Field of Classification Search ..... 62/6, 62/324.1

See application file for complete search history.

(56) References Cited

U.S. PATENT DOCUMENTS

| | | | | |
|---|---|---|---|---|
| 4,485,631 | A * | 12/1984 | Winkler | 62/55.5 |
| 6,094,921 | A * | 8/2000 | Zhu et al. | 62/6 |
| 6,205,792 | B1 * | 3/2001 | Anderson | 62/6 |
| 6,256,998 | B1 * | 7/2001 | Gao | 62/6 |
| 6,301,902 | B1 * | 10/2001 | Zhu et al. | 62/6 |
| 6,308,520 | B1 * | 10/2001 | Inoue et al. | 62/6 |
| 6,393,845 | B1 * | 5/2002 | Nogawa et al. | 62/6 |
| 6,397,605 | B1 * | 6/2002 | Pundak | 62/6 |
| 2001/0032469 | A1 * | 10/2001 | Zhu et al. | 62/6 |
| 2004/0040315 | A1 * | 3/2004 | Koyama et al. | 62/6 |

* cited by examiner

*Primary Examiner*—William C. Doerrler
(74) *Attorney, Agent, or Firm*—Katten Muchin Roseman LLP

(57) ABSTRACT

This invention provides an improved means of quickly warming a pulse tube (165) by shifting the phase relation of flow to the warm end of the pulse tube relative to flow to the warm end (117) of the pulse tube relative to flow to the warm end of the regenerator (160) using a "four valve" concept and the "active buffer" concept. Several different pulse tube configurations and valve timing relations that are effective at reversing the cycle from the normal mode, which produces cooling at the pulse tube heat station, to a reverse mode that produces heating are disclosed.

12 Claims, 5 Drawing Sheets

COOLING

WARMUP

COOLING

WARMING

SHOWN AT 225 DEG.

FAST WARM UP PULSE TUBE

This application is the National Stage of International Application No. PCT/US03/06580, filed Mar. 5, 2003, which claims the benefit under 35 U.S.C. 119(e) of U.S. Provisional Application No. 60/361,651, filed Mar. 5, 2002.

BACKGROUND OF THE INVENTION

The Gifford-McMahon (G-M) type pulse tube refrigerator is a cryocooler, similar to G-M refrigerators, that derives cooling from the compression and expansion of gas. However, unlike the G-M systems, in which the gas expansion work is transferred out of the expansion space by a solid expansion piston or displacer, pulse tube refrigerators have no moving parts in their cold end, but rather an oscillating gas column within the pulse tube that functions as a compressible displacer. The elimination of moving parts in the cold end of pulse tube refrigerators allows a significant reduction of vibration, as well as greater reliability and lifetime, and is thus potentially very useful in cooling cryopumps, which are often used to purge gases from semiconductor fabrication vacuum chambers.

G-M type pulse tube refrigerators are characterized by having a compressor that is connected to a remote expander by high and low pressure gas lines. The pulse tube expander has a valve mechanism that alternately pressurizes and depressurizes the regenerators and pulse tubes to produce refrigeration at cryogenic temperatures.

A Cryopump cooled by a Pulse Tube refrigerator needs to be quickly regenerated to minimize the time it is out of service. At present heaters are being used with GM refrigerators to rapidly warm up the cryopanels. Heaters can also be used to warm up cryopumps that are cooled by pulse tubes e.g. as disclosed in Japanese patent 00283036. When using a pulse tube to cool the cryopanels, warm up can also be achieved without heaters by circulating gas through the pulse tube, such as described in U.S. Pat. No. 5,927,081.

It is the object of the present invention to provide an improved means of quickly warming a pulse tube.

SUMMARY

This invention provides an improved means of quickly warming a pulse tube by shifting the phase relation of flow to the warm end of the pulse tube relative to flow to the warm end of the regenerator. Not all pulse tube phase shifting mechanisms lend themselves to fast warm up by changing the valve timing. Surprisingly, there are several different pulse tube configurations and valve timing relations that are effective at reversing the cycle from the normal mode, which produces cooling at the pulse tube heat station, to a reverse mode that produces heating.

Two phasing mechanisms that lend themselves to fast warm up are the "four valve" concept and the "active buffer" concept. These were first described in the following papers, I] Y. Matsubara, J. L. Gao, K Tanida, Y. Hiresaki, and M. Kaneko, "An experimental and analytical investigation of 4 K pulse tube refrigerator", Proc. 7$^{th}$ Intl Cryocooler Conf., Air Force Report PL-(P-93-1001 (1993) pp. 166–186; and 2] S. W. Zhu, Y Kakami, K Fujioka, and Y Matsubar, "Active-buffer pulse tube refrigerator", Proceedings of the 16th Cryogenic Engineering Conference, T. Haruyama. T. Mitsui and K. Yamafriji. ed. Eisevier Science. Oxford (1997), pp. 291–294.

A split rotary valve is disclosed that illustrates a simple means of providing the desired change of phase when it is turned in reverse. Single stage pulse tubes are used to illustrate the invention but the principals can be applied equally well to multi-stage pulse tubes.

Cryopumps, which are cooled by two stage pulse tubes that use this invention, can be quickly warmed up without the need for heaters.

Disclosed are several different pulse tube configurations and valve timing relations that are effective at reversing the cycle from the normal mode, which produces cooling at the pulse tube heat station, to a reverse mode that produces heating.

In one embodiment of the invention, a split rotary valve illustrates a simple means of providing the desired change of phase when it is turned in reverse.

BRIEF DESCRIPTION OF THE DRAWINGS

FIGS. 6*bb* and 6*cc* show views from the back of each valve disc while it is rotating in reverse to produce heating as shown in FIG. 5*b*.

DETAILED DESCRIPTION OF THE INVENTION

The present invention is applicable to G-M type pulse tubes that use valves to control the phase relationship of the flow to the warm end of the regenerator relative to the flow to the warm end of the pulse tube. By changing the phase relationship, the pulse tube can be made to shift from a cooling mode to a warming mode.

Figure 1:
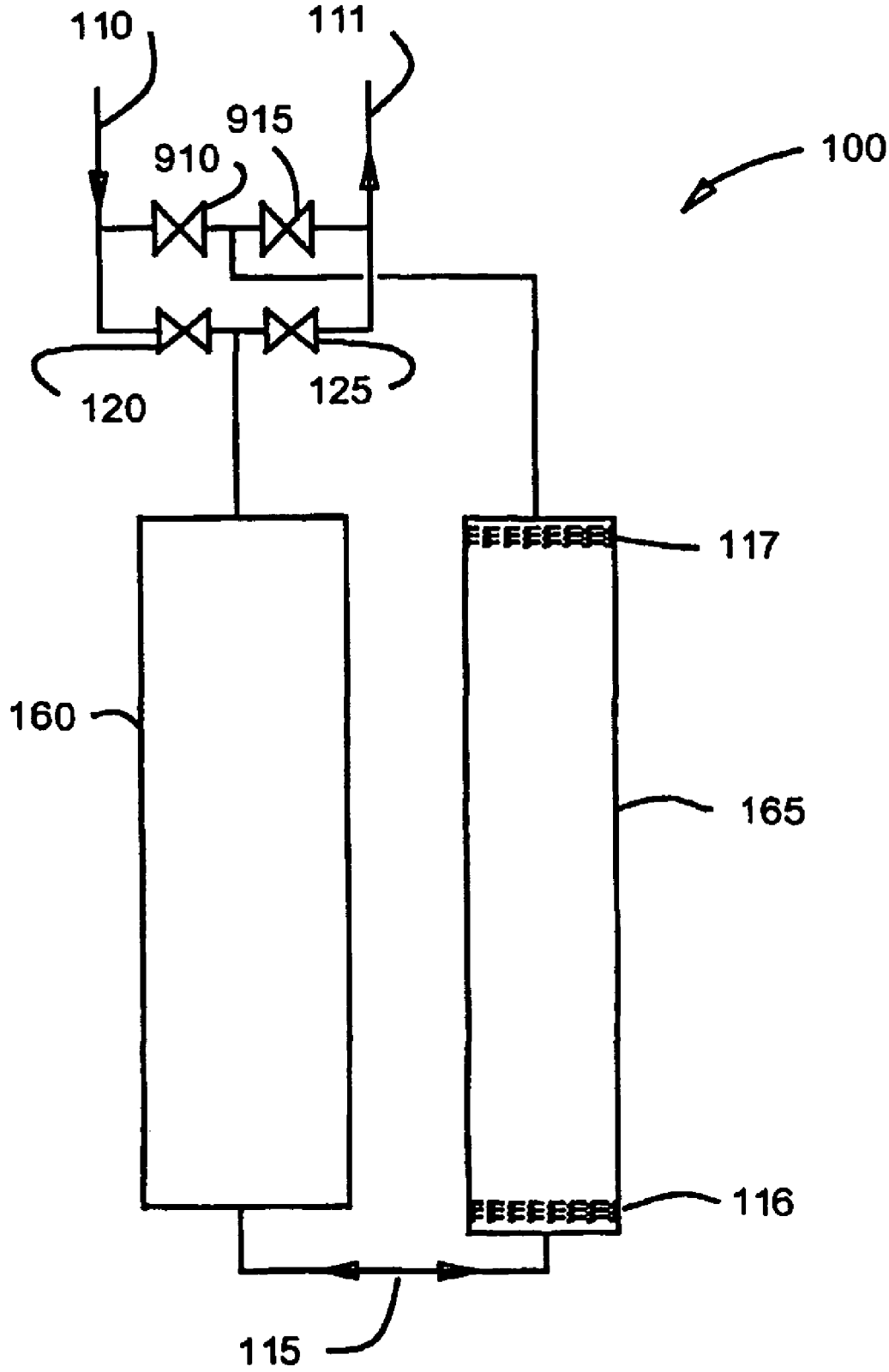
FIG. 1 is a schematic of a single stage pulse tube that is known in the art as having "four valve" control and to which the present invention can be applied.

The single stage pulse tube shown in FIG. 1 illustrates an embodiment of the invention. FIG. 1 shows Pulse Tube Refrigerator 100, which is comprised of Regenerator 160, Pulse Tube 165, Connecting Tube 115. Gas Line 110, Gas Line 111, Valve 120, Valve 125, Valve 910, Valve 915, Cold Heat Station 116, and Hot Heat Station 117.

Gas Line 110 brings high-pressure gas from the compressor and Gas Line 111 returns gas at low pressure to the compressor. Valve 120 admits high-pressure gas to the warm end of Regenerator 160 and Valve 125 returns gas from the warm end of Regenerator 160 to the compressor. Valve 910 admits high-pressure gas to the warm end of Pulse Tube 165 and Valve 915 returns gas from the warm end of Pulse Tube 165 to the compressor. Connecting Tube 115 connects the cold end of Regenerator 160 with the cold end of Pulse Tube 165. Heat is picked up at the cold end of Pulse Tube 165 in Cold Heat Station 116. It may be transferred to ambient temperature from Hot Heat Station 117, or returned to the compressor through Valve 915.

Figure 5A:
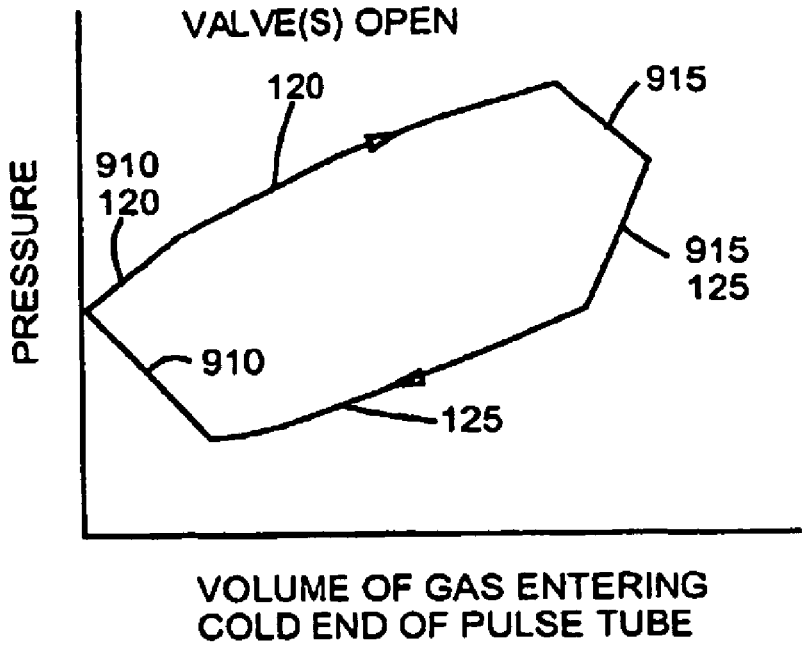
FIG. 5*a* is a pressure vs. volume (P-V) plot of the gas that enters the cold end of the FIG. 1 pulse tube during the normal cooling mode.

Cooling is produced at the cold end of Pulse Tube Refrigerator 100 when the valve timing is approximately as shown in Table 1 under the heading "COOLING". With this timing the P-V relation for the gas flowing in and out of the cold end of Pulse Tube 165 is approximately as shown in FIG. 5*a*. The phases when each of the valves is open are noted on FIG. 5*a*.

A P-V plot that follows a clockwise path is known to produce work. The work is equal to the cooling that is produced and can be measured from the area of the P-V plot. Energy in the form of work is transferred from a low temperature to ambient temperature.

Figure 5B:
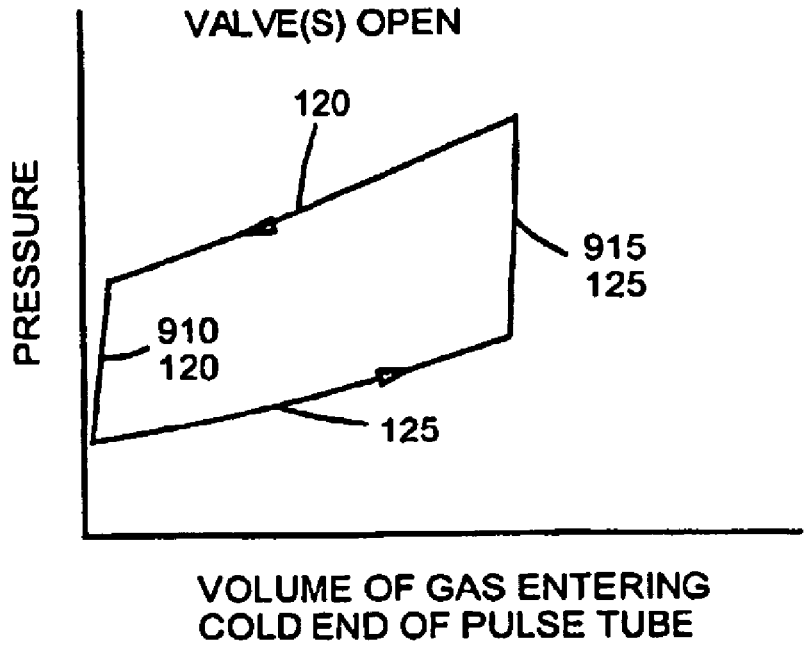
FIG. 5*b* is a P-V plot of the gas that enters the cold end of the FIG. 1 pulse tube during the heating mode per this invention.

When the timing of opening and closing Valves 910 and 915 relative to Valves 120 and 125 is changed as shown in Table 1 under the heading listed "WARM UP", the P-V relation changes to approximately the plot shown in FIG. 5*b*. This plot follows a counter clockwise path that transfers work energy from ambient temperature to the cold end of Pulse Tube 165. The heating is equal to the amount of work that is transferred and will cause the cold end of Pulse Tube 165 to warm up.

Figure 2:
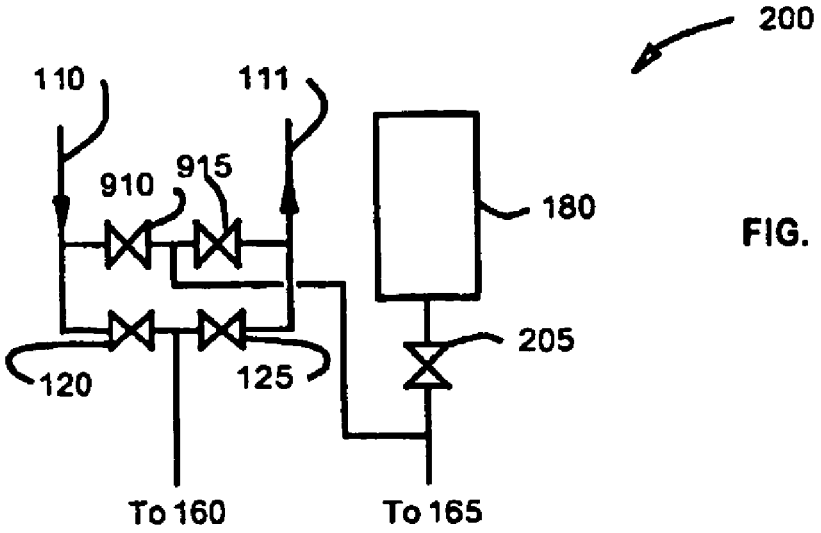
FIG. 2 is a schematic of a variation of the FIG. 1 control scheme to which the present invention can be applied.

FIG. 2 shows Pulse Tube Refrigerator 200 as a variation of the FIG. 1 control scheme in which Buffer Tank 180 is connected to the warm end of Pulse Tube 165. Valve 205 controls the timing of flow in and out of Buffer Tank 180. Valve timing for the normal cooling mode is shown in the upper part of Table 2 and timing for the warm up mode is shown in the lower part of Table 2. Adding Buffer Tank 180 and Valve 205 improves the efficiency of the pulse tube relative to FIG. 1 by having some of the gas that flows to and from the warm end of the pulse tube come from Buffer Tank 180 rather than from the compressor. The P-V plots for cooling and heating are essentially the same as those shown in FIGS. 5*a* and 5*b*. In the cooling mode, this is accomplished by opening Valve 205 before opening Valve 190.

Figure 3:
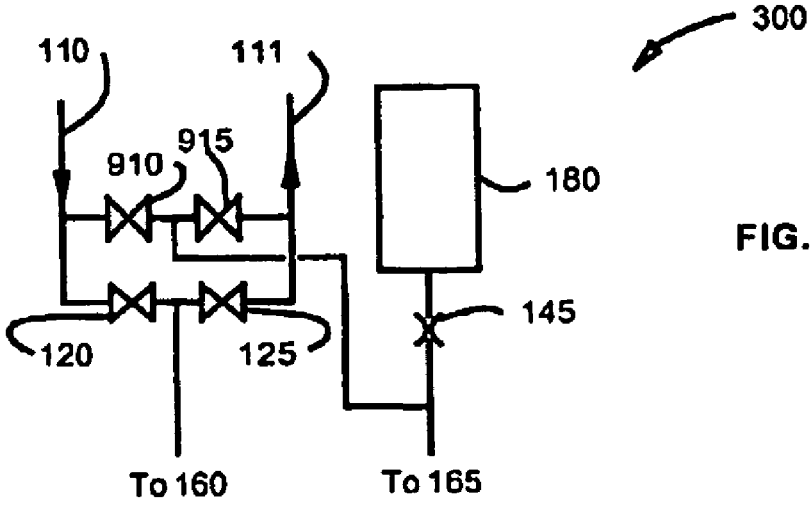
FIG. 3 is a schematic of a second variation of the FIG. 1 control scheme to which the present invention can be applied.

FIG. 3 shows Pulse Tube Refrigerator 300 as a variation of Pulse Tube 200 in which Valve 205 is replaced with Fixed Restrictor 145. It serves the same function as Valve 205 but is less efficient because gas flows in and out of Buffer Tank 180 during the entire cycle and some of the gas comes direct from the compressor. Valve timing is approximately the same as shown in Table 2 with Valve 205 deleted. The P-V plots for cooling and warm up are similar to FIGS. 5*a* and 5*b*.

Figure 4:
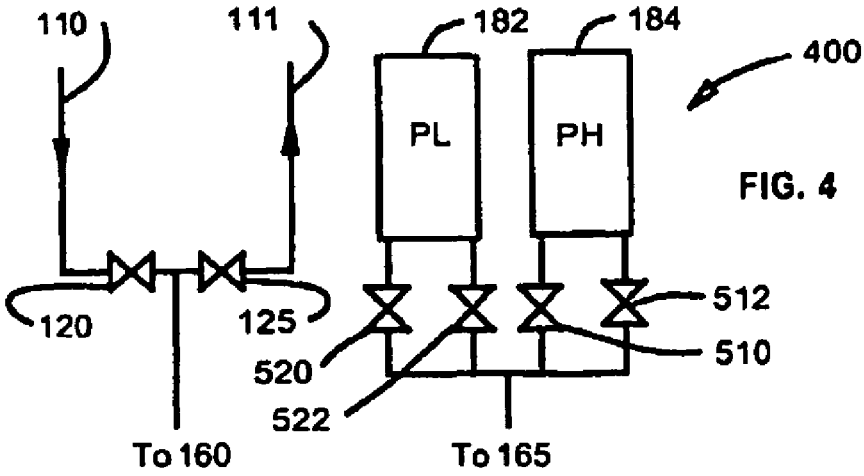
FIG. 4 is a schematic of a single stage pulse tube that is known in the art as having "active buffer" control.

FIG. 4 is a schematic of Pulse Tube Refrigerator 400, which has "active buffer" control. Gas from the compressor flows through Gas Line 110 into the warm end of Regenerator 160 through Valve 120. Gas returns to the compressor from Regenerator 160 through Valve 125 and Gas Line 111. Gas flow to and from the warm end of Pulse Tube 165 comes through Valves 510 and 512, which connect to Buffer Tank 184 and through Valves 520 and 522. which connect to Buffer Tank 182. Buffer Tank 184 is near high pressure, PH, and Buffer Tank 182 is near low pressure, PL.

Table 3 shows the valve timing for cooling in the upper part of the table and for warm up in the lower part of the table. The standard active buffer control system that is designed solely for cooling would have a single valve, Valve 510, in place of Valves 510 and 512 and a single valve, Valve 520, in place of Valves 520 and 522. In order to have a counter clockwise path for the PV plot, so the pulse tube will quickly warm up, it is necessary to add Valves 512 and 522 and shift their timing relative to the other valves.

Figure 6:
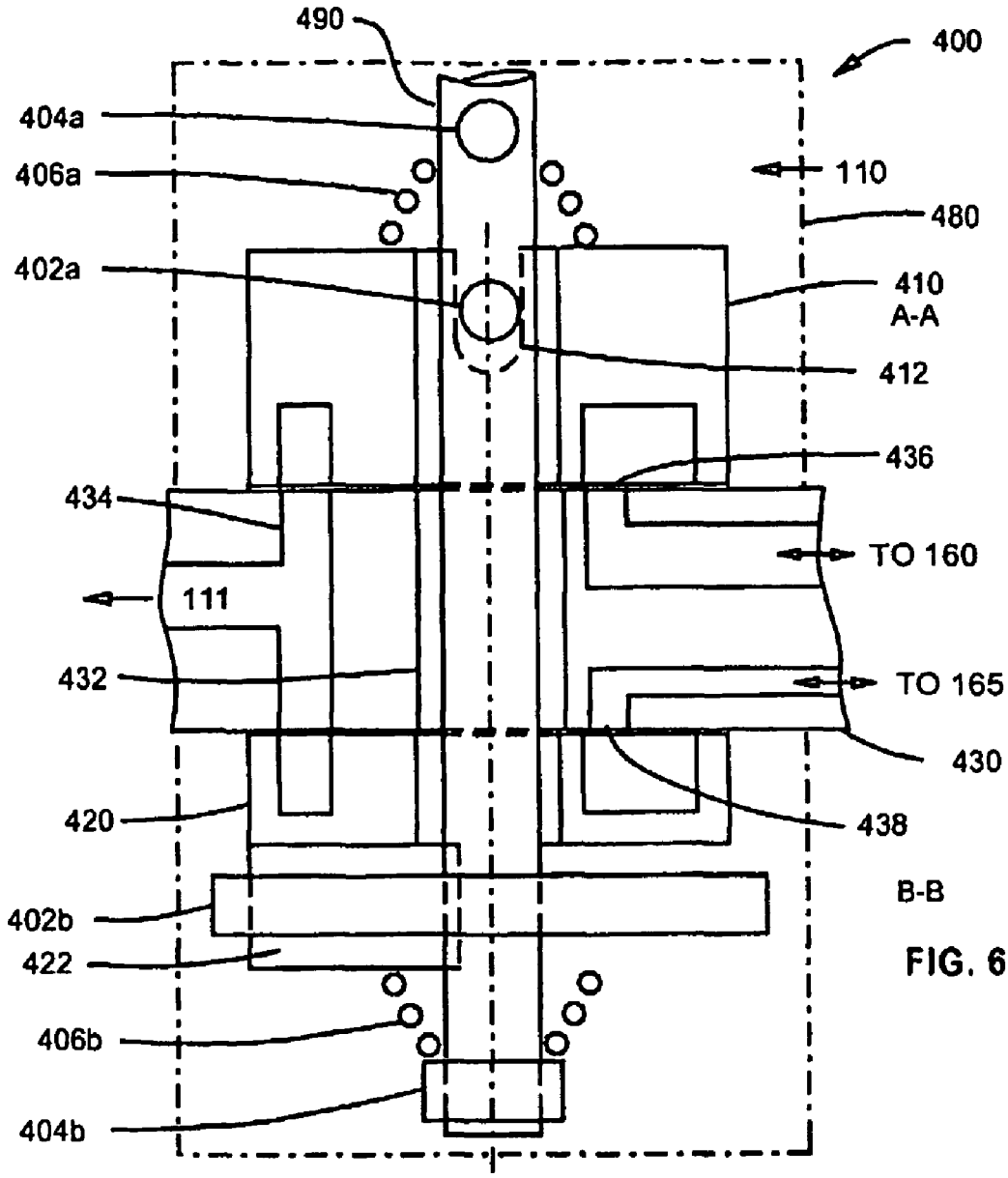
FIG. 6 is a cross section of dual rotary valve that can implement the P-V plot shown in FIG. 5.

FIG. 6 is a cross section of dual rotary valve Assembly 400 that can implement the P-V plot shown in FIGS. 5*a* and 5*b*. Assembly 400 is comprised of a fixed Valve Plate 430. primary Valve Disc 410, secondary Valve Disc 420 Drive Shaft 490, Drive Pins 402. Springs 406, spring Retainer Pins 402, and Enclosure 480.

Figure 6B:
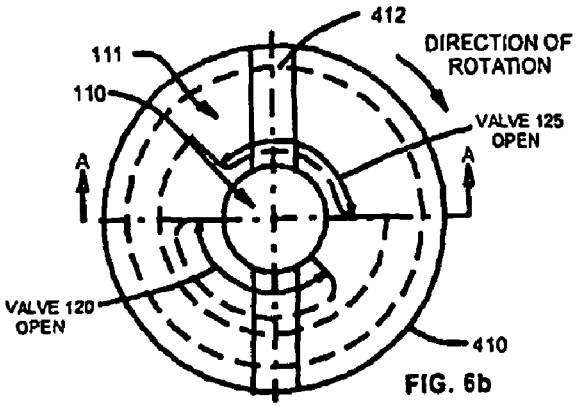
FIGS. 6*b* and 6*c* show views from the back of each valve disc while it is rotating to produce cooling as shown in FIG. 5*a*.
Figure 6B:
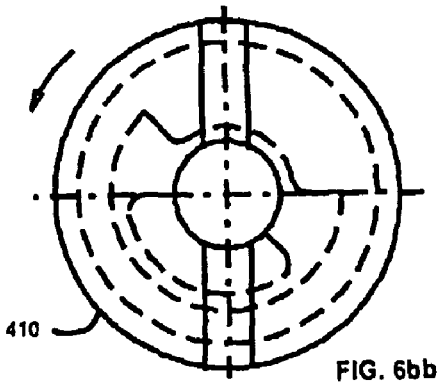
Figure 6A:
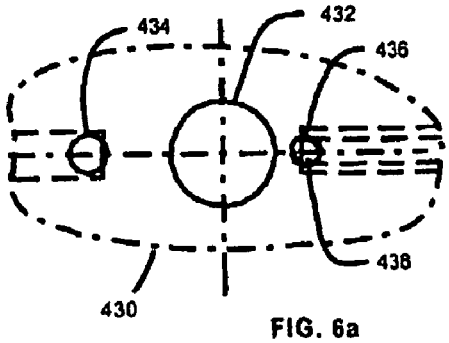
FIG. 6*a* is a top view of the valve plate.

A top view of Valve Plate 430 is shown in FIG. 6*a*. Valve Plate 430 has a center hole 432, through which Drive Shaft 490 and high-pressure gas pass, Port 430 which connects to low-pressure return line 111, Port 436 which connects Valve Disc 410 to the warm end of Regenerator 160, and Port 438 which connects Valve Disc 420 to the warm end of Pulse Tube 165.

FIG. 6*b* shows a top view of Valve Disc 410 as it is rotating in a clockwise direction. Drive Pin 402*a*, which is engaged in Slot 412, drives Valve Disc 410. A mechanism to center the valve discs on Shaft 490 without blocking the flow of high-pressure gas is not shown. The face of Valve Disc 410 that is in contact with Valve Plate 430 has slots that alternately connect the high-pressure supply and low-pressure return gas to Port 436.

With reference to Table 1 "Cooling", Valve Disc 410 is shown at 225° with Valve 125 (FIG. 1) just opening. The slot shown in cross section A—A connects the warm end of Regenerator 160 to low-pressure Port 434 for about 125°. FIG. 6*b* shows the slot that affects the open period for Valve 120. This slot connects the high-pressure supply from Line 110 to the warm end of Regenerator 160 for about 125°. High-pressure gas 110 acting on the back side of Valve Disc 410 and low-pressure gas 111 in the slot on the face create a pressure difference during operation that results in a force that seats Valve Disc 410 against Valve Plate 430. Prior to starting the compressor Spring 406*a*, which is retained by Pin 404*a*. holds Valve Disc 410 against Valve Plate 430 with sufficient force to get an initial seal.

Figure 6C:
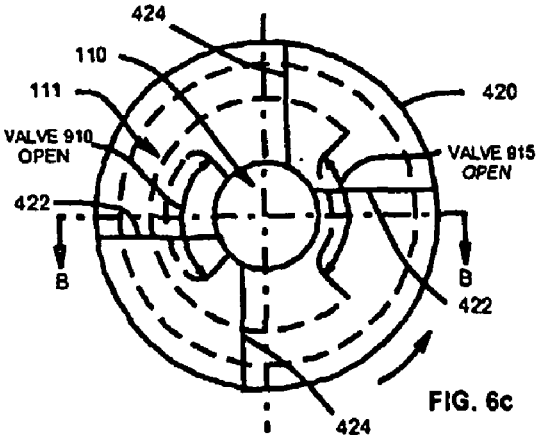
Figure 6C:
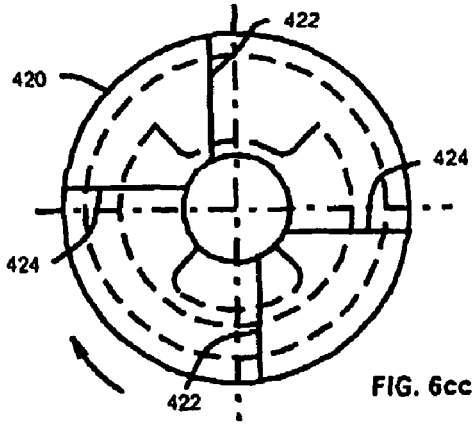

FIG. 6*c* shows a view from the back of Valve Disc 420 as it is rotating in the same direction as Valve Disc 410. Drive Pin 402*b* engages Faces 422 to drive Valve Disc 420. The gap between Faces 422 and 424 can be thought of as a slot like 412 that has been enlarged. The face of Valve Disc 420 that is in contact with Valve Plate 430 has slots that alternately connect the high-pressure supply and low-pressure return gas to Port 438. With reference to Table 1 "Cooling", Valve Disc 420 is shown at 2250, with Valve 915 (FIG. 1) open. The slot shown in cross section B–B connects the warm end of Pulse Tube 165 to low-pressure Port 434 for about 90°.

FIG. 6*c* shows the slot that affects the open period for Valve 910. This slot connects the high-pressure supply from Line 110 to the warm end of Pulse Tube 165 for about 90°. High-pressure gas 110 acting on the back side of Valve Disc 420 and low-pressure gas 111 in the slot on the face create a pressure difference during operation that results in a force that seats Valve Disc 420 against Valve Plate 430. Prior to starting the compressor Spring 406*b*, which is retained by Pin 404*b*, holds Valve Disc 420 against Valve Plate 430 with sufficient force to get an initial seal.

Rotation of Valve Discs 410 and 420 in the direction shown in FIGS. 6*b* and 6*c* produces cooling as shown in FIG. 5*a*. FIGS. 6*bb* and 6*cc* show Valve Discs 410 and 420 being turned in the opposite direction by having reversed the direction of rotation of Drive Shaft 412. Valve Disc 410 is shown in the same position as in FIG. 6*b* but Drive Pin 402*a* is acting on the other side of Slot 412. Valve Disc 420, on the other hand, is shown rotated about 90°, with Drive Pin 402*b* now acting on Faces 424. The shift in angular position of Valve Disc 420 relative to Valve Disc 410 affects the valve timing shown in table 1 under "Warm Up" and results in the P-V plot shown in FIG. 5*b*.

FIG. 6 shows a valve assembly that executes one cycle of the pulse tube with one revolution of the valve. This was done to keep the drawing simple. In actual practice it is more common to have two cycles of the pulse tube for each revolution of the valve discs in order to have the valve face wear more uniformly. Valve assemblies similar to the one shown in FIG. 6 can also be made to implement the valve timing in the cooling and warm up modes shown in Tables 2 and 3. Similar valve assemblies can be made for two stage pulse tubes that would provide cooling in one direction of rotation and heating in the other.

The invention claimed is:

1. A method of shifting a G-M type pulse tube from a cooling mode to a warming mode using valves to change the phase relationship of the flow to the warm end of the regenerator relative to the flow to the warm end of the pulse tube.

2. A pulse tube refrigerator, comprising at least one regenerator, at least one pulse tube, a connecting tube, a first gas line, a second gas line, a first valve 120, a second valve 125, a third valve 910, a fourth valve 915, a cold heat station, and a hot heat station wherein the first gas line brings high-pressure gas from a compressor and the second gas line returns gas at low pressure to the compressor, the first valve 120 admits high-pressure gas to the warm end of the regenerator and the second valve 125 returns gas from the warm end of the regenerator to the compressor; third valve 910 admits high-pressure gas to the warm end of the pulse tube and the fourth valve 915 returns gas from the warm end of the pulse tube to the compressor; the connecting tube connects the cold end of the regenerator with the cold end of the pulse tube such that heat is picked up at the cold end of the pulse tube in the cold heat station and transferred to ambient temperature from the hot heat station or returned to the compressor through the fourth valve 915 cooling is produced at the cold end of the pulse tube refrigerator when the valve timing is approximately

| | | | | | | |
|---|---|---|---|---|---|---|
| | 120 Open | | | 125 Open | | |
| 910 Open | | | 915 Open | | | |

0° 90° 180° 270° 360° and when the timing of opening and closing valves 910 and 915 relative to valves 120 and 125 is changed to

| | | | | | | |
|---|---|---|---|---|---|---|
| | 120 Open | | | 125 Open | | |
| | | 910 Open | | | 915 Open | |

0° 90° 180° 270° 360° work energy transfers from ambient temperature to the cold end of pulse tube 165 causing the cold end of pulse tube 165 to warm up.

3. The refrigerator of claim 2 also comprising a buffer tank connected to the warm end of pulse tube through a flow restrictor or a fifth valve 205 that controls the timing of flow in and out of the buffer tank and to the line connecting valves 910 and 915.

4. The refrigerator of claim 3 where a fifth valve 205 is used for timing of flow and the valve timing for the normal cooling mode is

| | | | | | | | |
|---|---|---|---|---|---|---|---|
| | 120 Open | | | | 125 Open | | |
| 205 | | | | 205 | | | |
| | 190 Open | | | | 915 Open | | |

0° 90° 180° 270° 360° and for the warm up mode is

| | | | | | | | |
|---|---|---|---|---|---|---|---|
| | 120 Open | | | | 125 Open | | |
| | | 205 | | | | 205 | |
| 915 | | | 910 Open | | | | 915 |

0° 90° 180° 270° 360°

.

5. The refrigerator of claim 3 where the buffer tank is connected to the warm end of pulse tube through a flow restrictor.

6. A pulse tube refrigerator with active buffer control, where shifting a G-M type pulse tube from a cooling mode to a warming mode using valves changes the phase relationship of the flow to the warm end of the regenerator relative to the flow to the warm end of the pulse tube and where gas from the compressor flows through a first gas line into the warm end of a regenerator through a first valve 120, gas returns to the compressor from regenerator through a second valve 125 and a second gas line, gas flow to and from the warm end of pulse tube comes through a third valve 510 and a fourth valve 512 which connect to a first buffer tank and through fifth valve 520 and sixth valve 522 which connect to a second buffer tank.

7. The refrigerator of claim 6 where the valve timing for the normal cooling mode is

| | | | | | | | |
|---|---|---|---|---|---|---|---|
| | 120 Open | | | | 125 Open | | |
| | | | 510 | | | | 520 |
| 512 | | | | 522 | | | |

0° 90° 180° 270° 360° timing during warm up mode is

| | | | | | | | |
|---|---|---|---|---|---|---|---|
| | 120 Open | | | | 125 Open | | |
| | | | 510 | | | | 520 |
| | 522 | | | | 512 | | |

0° 90° 180° 270° 360°

.

8. A GM type pulse tube refrigerator, comprising a regenerator having a warm end and a cold end, a pulse tube having a warm end and a cold end, the cold end of the pulse tube being connected to the cold end of the regenerator, and a valve mechanism that cycles gas flow to the warm end of the regenerator and to the warm end of the pulse tube, where the phase relation of gas flow to the regenerator and to the pulse tube produces one of cooling or heating at the cold end of the pulse tube depending on the configuration of the valve mechanism.

9. A pulse tube refrigerator as in claim 8 where said valve mechanism consists of a primary rotary disc and a secondary rotary disc on a common drive shaft.

10. A valve mechanism as in claim 9 where the angular position of said secondary disc shifts relative to said primary disc when the direction of rotation is reversed.

11. A pulse tube refrigerator as in claim 8 wherein a cryopanel is attached to a heat station at the cold end of said pulse tube.

12. A pulse tube refrigerator with a cryopanel as in claim 11 wherein said change of phase relation is used to warm-up the cryopanel.

* * * * *